US008970367B2

(12) United States Patent
Meraz

(10) Patent No.: US 8,970,367 B2
(45) Date of Patent: Mar. 3, 2015

(54) PERSON ON BOARD SYSTEM AND METHOD

(71) Applicant: Aquila Offshore, LLC, Richmond, TX (US)

(72) Inventor: Jose Meraz, Richmond, TX (US)

( * ) Notice: Subject to any disclaimer, the term of this patent is extended or adjusted under 35 U.S.C. 154(b) by 157 days.

(21) Appl. No.: 13/894,609

(22) Filed: May 15, 2013

(65) Prior Publication Data

US 2014/0340220 A1 Nov. 20, 2014

(51) Int. Cl.
*G08B 1/08* (2006.01)
*G08B 26/00* (2006.01)

(52) U.S. Cl.
CPC ..... *G08B 26/008* (2013.01)
USPC ..... 340/539.13; 340/8.1; 340/572.1; 340/286.11; 340/539.11; 235/382

(58) Field of Classification Search
USPC ..... 340/572.1, 286.11, 286.14, 539.11, 340/539.13; 235/382
See application file for complete search history.

(56) References Cited

U.S. PATENT DOCUMENTS

| | | | | |
|---|---|---|---|---|
| 7,242,303 | B2 | 7/2007 | Patel et al. | |
| 7,768,394 | B2 | 8/2010 | Amidi | |
| 7,868,760 | B2 | 1/2011 | Smith et al. | |
| 7,916,024 | B2 | 3/2011 | Gennard | |
| 8,284,061 | B1 * | 10/2012 | Dione | 340/572.1 |
| 8,888,002 | B2 * | 11/2014 | Marshall Chesney et al. | 235/382 |
| 2004/0252023 | A1 * | 12/2004 | Xydis | 340/539.11 |
| 2005/0075116 | A1 * | 4/2005 | Laird et al. | 455/456.3 |
| 2006/0250271 | A1 * | 11/2006 | Zimmerman | 340/825.36 |
| 2007/0044539 | A1 * | 3/2007 | Sabol et al. | 73/19.01 |
| 2008/0109099 | A1 | 5/2008 | Moshier | |
| 2008/0129467 | A1 * | 6/2008 | Gennard | 340/286.11 |
| 2008/0314681 | A1 * | 12/2008 | Patel et al. | 182/18 |
| 2010/0282839 | A1 * | 11/2010 | Zura et al. | 235/382 |
| 2011/0109434 | A1 * | 5/2011 | Hadsall, Sr. | 340/8.1 |
| 2011/0215910 | A1 * | 9/2011 | Bouressa | 340/10.1 |
| 2012/0280812 | A1 * | 11/2012 | Sheikman et al. | 340/539.13 |
| 2014/0076969 | A1 * | 3/2014 | Marshall Chesney et al. | 235/382 |
| 2014/0340220 | A1 * | 11/2014 | Meraz, Jose | 340/539.13 |

* cited by examiner

*Primary Examiner* — Hoi Lau
(74) *Attorney, Agent, or Firm* — Kenneth L. Nash

(57) ABSTRACT

A system and method provides updated personnel count information for offshore locations for daily use and use during emergencies that is coordinated with a cloud database. The system allows persons not at an offshore rig or installation to monitor the presence, excuse, or absence of personnel at fixed mustering stations and moveable mustering stations such as lifeboats and the launch status of particular lifeboats. The system provides simplified touch screen information that is intuitively available to obtain user profiles for persons missing, present and excused from being present at mustering stations as well as participation in drills or emergency situations.

20 Claims, 3 Drawing Sheets

PERSON ON BOARD SYSTEM AND METHOD

BACKGROUND OF THE INVENTION

1. Field of the Invention

The present invention relates generally to offshore personnel monitoring systems, and more specifically to a person on board system that can be used on a daily basis with features for use in emergency and abandonment situations for offshore applications including oil rigs and oil platforms.

2. Background of the Invention

It is desirable to keep track of the count of persons at offshore facilities such as offshore rigs and platforms on a daily basis as well as during drills and emergency situations. During emergency situations, muster stations have long been used as centralized meeting points to disseminate information regarding fire, flood, explosion, and the like. Furthermore, the muster station allows for those in charge to calculate the number of people present at the station and to identify any absent people that need to be located, as compared to a master list of people present, to ensure all persons are accounted for during an evacuation.

Offshore applications, including oil rigs, platforms, and the like, rely on muster stations and drills to effectively account for people aboard the vessel. This process can prove challenging because of the sheer size, complex layout, and potential problems in various parts of the offshore installation. During drills it may not be desirable for all parties to participate. Additionally, the moving machines, increased noise, and dangerous tasks present on an off-shore oil rig or platform can make orderly evacuation of personnel increasingly challenging. Furthermore, the emergency procedures can be time-consuming and confusing for those involved, particularly as the number of people needed to be monitored increases. Improvements in muster stations and drills are desirous for the safety of all persons involved, because time is of the essence in an emergency situation.

The following patents discuss background art related to the above discussed subject matter:

U.S. Pat. No. 7,916,024 to Gennard, issued Mar. 29, 2011 discloses a muster apparatus for registering the arrival of a person at a location based on RFID technology, and includes detector means for detecting the arrival of the person at the location and a controller, the detector means being in signal communication with a programmable computer for receiving the information. Each identity tag contains a unique code to distinguish one RFID tag from another. The apparatus includes output means for communicating information from the controller to an operator at a command station. The apparatus is arranged so that the information communicated is dependent on the arrival of the person at the location.

U.S. Pat. No. 7,868,760 to Smith et al., issued Jan. 11, 2011, discloses a method for accounting for people in emergencies in industrial settings. This method and system utilizes RFID and UWB technology to track personnel during an emergency. Ultra-Wideband (UWB) transmitters associated with individuals or objects transmit information to UWB monitoring stations which then send the information to a computer, which calculates the location of the UWB transmitter. The system can be used despite severe multi-path effects and can provide location information in 3 dimensions. The system can include proximity-based RF equipment for access control or otherwise for identification in specific locations. Information from the proximity-based RF equipment is also sent to the computer which also receives information from the UWB monitoring stations.

U.S. Patent Application No. 2006/0250271 to Zimmerman, published Nov. 9, 2006, discloses a muster station and system for emergency communication. A system for providing emergency communication within a building comprises a command center and musters stations. A command module is located at the command center. Control modules are located at respective muster stations which are located in different areas within the building. At least one communication link provides communication between the command module at the command center and each of the control modules at the muster stations. RFID transmitters are distributed at the muster station to track the people in the event of an emergency, not distributed ahead of the emergency.

U.S. Patent Application No. 2008/0109099 to Moshier, published May 8, 2008, discloses an apparatus and method for process control using people and asset tracking information. An apparatus, method, and computer program for process control using people and asset tracking information are provided. One or more process control data elements are received, which define a location associated with a person and/or an asset in a processing environment. At least part of the processing environment is controlled using the one or more process control data elements. For example, the processing environment could be controlled based on whether a specified area has been evacuated or whether one or more specified personnel or types of personnel are present in the specified area. The location can also be used to prevent the person and/or the asset from entering a restricted part of the processing environment, identify any people failing to reach specified zones of the processing environment during an incident, and identify a current actual or estimated location of at least one person to be rescued in the processing environment.

There exists a need for a fire drill mustering system and method which addresses the problems and needs associated with the prior art listed above. Consequently, those skilled in the art will appreciate the present invention.

SUMMARY OF THE INVENTION

An object of the present invention is to provide an improved person on board system and method for offshore applications.

Another object of the present invention is to provide a muster system and method that more effectively locates and tracks people during and after an emergency situation.

Another object of the present invention is to provide a person on board system and method which centralizes information regarding personnel certifications into one reference card.

These and other objects, features, and advantages of the present invention will become clear from the figures and description given hereinafter. It is understood that the objects listed above are not all inclusive and are only intended to aid in understanding the present invention, not to limit the bounds of the present invention in any way.

In accordance with one embodiment of the present invention, a person on board system for an offshore location is disclosed which may comprise a plurality of identification cards each comprising a machine detectable identifier, a plurality of detectors operable for detecting the machine detectable identifier, and a cloud database for storing a plurality of user profiles associated with the plurality of identification cards.

A plurality of computers at the offshore location may be configured with a software program for interfacing with the cloud database. Some computers, such as those at muster stations, may also be connected to respective of the plurality of detectors. Moreover, computers positioned onshore or perhaps at locals ships or well locations may be configured for accessing the cloud database when deemed necessary.

The system may further comprise at least one registration station at the offshore location comprising at least one of the plurality of computers operably connected with the cloud database and at least one of the plurality of detectors for scanning identification cards entering the offshore location and for populating the cloud database with on board personnel. The system may comprise a first fixed mustering station positioned on a first side of the offshore location, e.g., the port or starboard side of the offshore location. This mustering station may comprise at least one of the plurality of computers operably connected with the cloud database and at least one of the plurality of detectors for registering a location of the plurality of identification cards upon arrival at the first mustering station. A first moveable mustering station may comprise a first lifeboat, and a first lifeboat sensor to detect movement of the first lifeboat, such as launching of the lifeboat.

In one embodiment, at least one of the plurality of computers comprises a touchscreen, wherein the touchscreen displays pictures of the on board personnel who are missing, excused, and present at the fixed mustering station during at least one of a drill or emergency.

In another embodiment, touching selected of the pictures of the on board personnel on the touchscreen may be responsive to access a respective of the plurality of user profiles.

The system may further comprise a signal wire operable for signaling a drill, emergency or abandonment, and a separate data line for communicating between the plurality of computers and the cloud database.

In another embodiment of the present invention, the system may further comprise a second fixed mustering station positioned on a second side of the offshore location. The second fixed mustering station may comprise at least one of the plurality of computers and at least one of the plurality of detectors for registering the location of the plurality of identification cards within the second fixed mustering station. A second moveable mustering station may comprise a second lifeboat and a second lifeboat sensor to detect movement of the second lifeboat. An onboard control station can be operably connected to the first fixed mustering station, the first moveable mustering station, the second fixed mustering station, and the second moveable mustering station for receiving data comprising the location of the plurality of identification cards and the respective personnel, a server in communication with the cloud database and the control station, and a radio transmitter operable for communication with the cloud database.

The system may comprise a computer operable for producing a daily list of the on board personnel and assigned beds and a list of beds available.

The system may further comprise a moveable detector operable for locating identification cards of missing personnel in the offshore location.

In one embodiment, each of the plurality of identification cards comprises an antenna and each of the plurality of detectors comprises an antenna.

In another embodiment of the present invention, a method for a person on board system for offshore locations is disclosed, which may comprise steps, such as providing a plurality of identification cards each comprising a machine detectable identifier, providing a plurality of detectors operable for detecting the machine detectable identifier at a plurality of the offshore locations, providing a cloud database for storing a plurality of user profiles associated with the plurality of identification cards, and providing that the user profiles comprise a plurality of certifications for work offshore wherein at least one certification is required for entering a respective of the plurality of offshore locations.

The method may further comprise providing a plurality of computers at the plurality of offshore locations configured with a software program for interfacing with the cloud database and the detectors, providing at least one registration station at each of the plurality of offshore locations comprising at least one of the plurality of computers operably connected with the cloud database and at least one of the plurality of detectors for scanning identification cards entering the offshore location and for populating the cloud database with on board personnel for each of the offshore locations. Other steps may comprise providing a first fixed mustering station positioned on each of the plurality of offshore locations, the first mustering station comprising at least one of the plurality of computers hosting the software program operably connected to at least one of the plurality of detectors for registering a location of the plurality of identification cards within a desired zone or region associated with the first mustering station.

In another embodiment, the method may comprise providing that at least one computer comprises a touchscreen, wherein the touchscreen comprises pictures of the on board personnel who are missing, excused, and present at the fixed mustering station during at least one of a drill or emergency.

The method may further comprise providing that individual the pictures of the on board personnel on the touchscreen are responsive to touch to provide information about individual of the on board personnel.

The method may comprise providing a signal wire on each of the plurality of offshore locations operable for signaling a drill or an emergency or abandonment, and providing a separate data line for communicating between the plurality of computers and the cloud database.

The method may further comprise steps such as providing a first lifeboat in close proximity to the first fixed mustering station for the plurality of offshore locations. The first lifeboat can be equipped with a sensor emitting tracking location to the cloud database, providing a first moveable mustering station comprising a first lifeboat, and providing a first lifeboat sensor to detect movement of the first lifeboat.

In another embodiment of the present invention, a method for a person on board system for offshore locations is disclosed, comprising steps such as providing a plurality of identification cards each comprising a machine detectable identifier, providing a plurality of detectors operable for detecting the machine detectable identifier at an offshore location, providing a cloud database for storing a plurality of user profiles associated with the plurality of identification cards, and providing a plurality of computers at the plurality of offshore locations configured with a software program for interfacing with the cloud database and the detectors.

The method further comprises providing at least one registration station at each of the plurality of offshore locations comprising at least one of the plurality of computers operably connected with the cloud database and at least one of the plurality of detectors for scanning identification cards entering the offshore location and for populating the cloud database with on board personnel for each of the offshore locations, providing a first fixed mustering station positioned on each of the plurality of offshore locations, the first mustering station comprising at least one of the plurality of computers hosting the software program and being operably connected to at least one of the plurality of detectors for registering a location of the plurality of identification cards within a desired zone of the first mustering station, and providing that at least one the plurality of computers comprises a touchscreen, wherein the touchscreen comprises pictures of the on board personnel who are missing, excused, and present at the fixed mustering station during at least one of a drill or emergency and that individual the pictures of the on board personnel on the touchscreen are responsive to touch to provide information about selected of the on board personnel.

In one embodiment, the method may comprise providing that the user profiles comprise certifications for work offshore required for entering respective of a plurality of offshore locations.

In another embodiment, the system may comprise providing that the touch screen comprises a button utilized to excuse personnel from a drill.

The method may further comprise providing a first lifeboat in close proximity to the first fixed mustering station for the plurality of offshore locations, the first lifeboat being equipped with a sensor emitting tracking location to the cloud database.

Other steps may include providing a first moveable mustering station comprising a first lifeboat, and providing a first lifeboat sensor to detect movement of the first lifeboat and providing a moveable detector that is wirelessly connected to at least one of the plurality of computers.

BRIEF DESCRIPTION OF THE DRAWINGS

The above general description and the following detailed description are merely illustrative of the generic invention, and additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
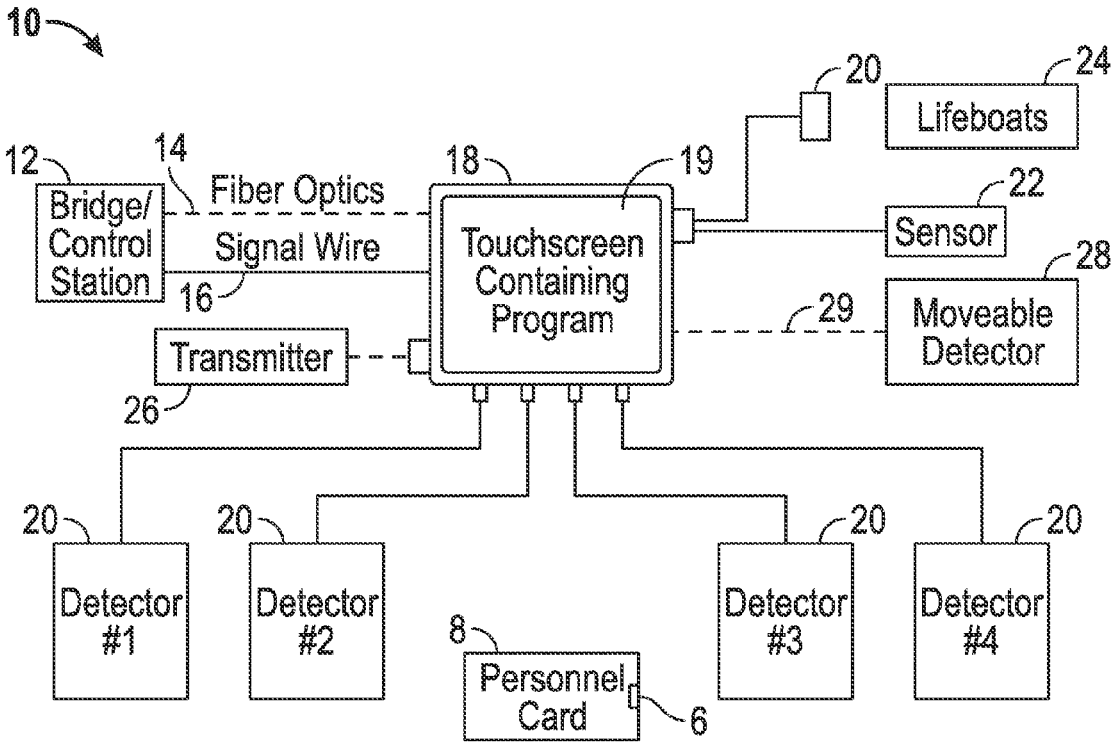
FIG. 1 is a diagram of a single muster apparatus for a person on board system in accord with one possible embodiment of the present invention.

Turning now to FIG. 1, a diagram of muster apparatus 10 is depicted in accord with one possible embodiment of the present invention. Muster apparatus 10 comprises touchscreen computer 18 with software 19 installed. Software 19 controls the registration of personnel, as well as information on each individual person, and will be discussed hereinafter in regards to FIGS. 4 & 5. In one embodiment, detectors 20 may be utilized in the muster stations to detect and identify personnel as they reach the fixed muster stations, moveable muster stations, temporarily fixed muster stations and the like. Detectors 20 can be switched off for normal rig operation and then switched on either automatically or manually for mustering and abandonment situations. Automatic detector operation may be controlled by signal wire 16, which is used in the rig to signal drills, emergencies, and rig abandonment situations. Touchscreen computer 18 can be mounted to a desired location at the muster station and used by designated personnel at the muster stations.

In this embodiment, a fixed muster station may be positioned near one or more lifeboats 24, with fixed position detectors 20 that detect the personnel at the muster station, as discussed hereinafter. However, not all muster stations are necessarily fixed. Moreover, detectors 20 are not necessarily fixed. Lifeboat 24 may effectively represent a tentatively fixed muster station that is rapidly moveable as necessary to abandon the rig. Moveable detector 28 is representative of a moveable station that is utilized to locate personnel who have not reported to their anticipated muster station, or who have arrived at the offshore location, or for a series of primary and secondary muster stations and lifeboats assigned to the offshore personnel.

For the fixed position muster station, detectors 20 may comprise antennas that are operably connected to computer 18, which may also be mounted in a fixed position, inside or encased or weather proofed as necessary. As one example, detectors 20 may be utilized for reading transmitter 6, which may comprise in one embodiment, an active or passive RFID chip 6 located on badge or personnel card 8, which is carried by all personnel. In this way, as each transmitter chip, such as an RFID is detected, an accurate count of identified personnel is obtained at the muster stations. Transmitter 6 typically comprises electronics of some type including an antenna. However, detectors 20 and/or personnel card 8 could also represent any type of detection system that at a minimum is able to provide accurate identification. Transmitter 6 could be passive, active, or may simply comprise a visual antenna that comprises reflective material of a bar code or other machine readable pattern, that effectively acts as a passive transmitter of a machine readable indicator associated with each personnel.

Accordingly, personnel cards 8 may comprise RFID or other types of transmitters. As another example, active transmitters of various types may be utilized that send ID, location information, or the like. Personnel cards 8 may be automatically or manually triggered to transmit after an alarm is sounded with detectors 20 placed around the rig so that personnel are more easily located whether at the muster station or not. For example, personnel cards may comprise longer range active RFID for this purpose or other types of transmitters. Personnel cards 8 may also comprise smart devices, vibrators, one way or two way voice, and/or may comprise a switch to turn on the transmitter. As well, various types of passive and active wearable sensors are available to detect identity but also can be used to detect presence, track, count personnel, and the like.

Detectors 20 may simply detect an initial presence or may continuously monitor the presence of personnel at a position within a desired area such as a fixed muster station and/or may be utilized to locate people on a rig generally. Detectors 20 and/or personnel cards 8 may utilize accelerometers, radio, infrared and ultrasound, facial recognition, gait recognition, pressure sensitive detectors, micro Doppler sensors, and/or other biometric detectors, to gauge health characteristics as well as identify, locate, and count. Personnel cards 8 may comprise bar codes or other machine readable codes that are scanned when passing into the muster area or at sensors positioned around the rig.

Once an alarm has been signaled by control station 12, signal wire 16 transmits the alarm to computer 18 and software 19 initiates the proper safety protocol. Signal wire 16 in some rigs may be dedicated for purposes of alarms and may not be suitable or configured to carry data or provide computer connections. Accordingly, other more suitable data lines may be used for this purpose such as fiber optic lines 14. Fiber optic data lines 14 can be used to send personnel status information to key control areas on the rig such as a control room 12 in the bridge. Drills and the like will typically be monitored from control room 12 where the persons, presence, timing and the like can be determined. Software 19 therefore can provide metrics regarding the effectiveness of drills e.g. how quickly and how many personnel were able to make their way to muster stations within a desired time frame.

Moveable detector 28 may be utilized around the rig for locating personnel cards 8 of persons who are not present at a muster station. In some cases, when personnel who are not excused or otherwise accounted for are not present then moveable detector 28 may be utilized to detect a transmission from the personnel card 8. The user may receive information about a previous location, e.g., location of work place or bed, from the system as discussed hereinafter. Accordingly, while detectors 20 can be mounted at fixed muster stations or other desired locations, detectors 20 can also be mobile. Moveable detector 28 may also comprise a Wi-Fi connection 29 or other suitable transmitter that connects to computer 18 whereby location of the missing person is indicated.

As discussed hereinafter, cloud database 34 (See FIG. 3) is utilized to maintain records for daily use and in case of an emergency or drills to allow monitoring from another location off the rig, perhaps from a long distance away. While other means are discussed hereinafter for connection to cloud database 34, if desired, each muster station may also comprise transmitter 26, Wi-Fi, or another line to microwave transmitters on the offshore location, to provide another connection to cloud database 34 (See FIG. 3) that is accessible by persons off the rig, in case other communication lines such as fiber optic line 14 are not available in a particular emergency.

Cloud database 34 as used herein means a database that comprises electronic storage that is not physically present on the particular offshore installation at which a drill or emergency occurs. The cloud database 34 may be onshore, at a company headquarters, may be rented data storage or combinations of these. A corresponding matching database may be maintained on the offshore location that is continuously or frequently updated with changes or the like.

In this embodiment, the available safety protocols are muster and abandon, although other protocols could be added. In other embodiments, alternative emergency preparedness drills may also be initiated by software 19. As personnel reach muster apparatus 10, detectors 20 will recognize personnel cards 8 and register the location of personnel into software 19. This information is then transmitted to control station 12 by fiber optic wire 14.

If it is necessary to abandon the rig on lifeboats 24, which can be announced and/or indicated by sirens, lights, or the like, as may be controlled by signal wire 16, then sensors 22 associated with individual lifeboats 24 provide a status for the progress of offshore rig abandonment. Detector 20 can detect not only who is on a lifeboat but also sensor 22 can detect whether the lifeboat has been launched. This information may be very important in some emergency situations. Detectors 20 and/or sensors 22 can be mounted either in the lifeboat and/or adjacent the lifeboat and may be wired and/or wirelessly interconnected with computer 18. Accordingly, in embodiment of the invention, detailed information about personnel and their status as being on or off the rig during all phases of drills and emergencies is available in accord with the present invention not only onboard the rig but also to other offshore personnel, rescue ships, on shore personnel, or the like that have access to information in cloud database 34, which can be updated continuously during emergencies, or at desired intervals, and regularly, e.g., twice daily, or selectively, for normal operations.

Figure 2:
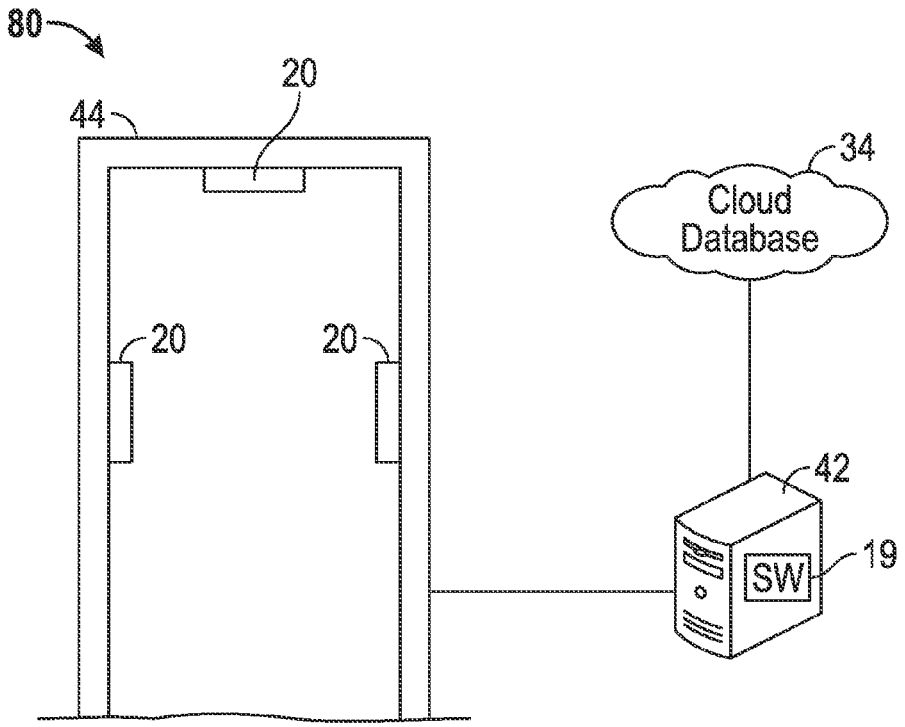
FIG. 2 is a diagram of a registration station for a person on board system in accord with one possible embodiment of the present invention.

FIG. 2 is a diagram of registration station 80 in accord with one possible embodiment of the present invention. As personnel reach and/or leave the platform or rig, they can be directed to pass through registration station 80 preferably located at each helicopter office, or supply ship offload area, where people arrive and depart. In this embodiment, detectors 20 will read a signal from identification card 8 as personnel cross threshold of fixed portal 44. Each identification card 8 will be associated with a unique number, preferably one of a kind machine readable indicator or identification number. This information is then transmitted to computer 42, where software 19 uses the information to keep track of the total number of personnel onboard. Registration station 80 can also be configured at other points of entrance and exit from rig, to ensure a constant real time count of any personnel on board at a given time.

Computer monitor 42 may display pertinent information about the personnel arriving at the platform or rig, including, but not limited to, a picture, a room number, primary and secondary assigned muster stations, lifeboat assignments, any certifications needed or expiring, and other useful information. Accordingly, information that may be stored on identification card 8 and/or stored in cloud database 34 may be utilized to provide information about the personnel onboard the platform or rig. Person on board system 100 (see FIG. 3) will therefore know exactly how many personnel are onboard at any time, instantly providing an up to date count of personnel should an emergency arise. In one embodiment, muster system 100 may automatically generate a report of the total number of personnel on board each platform or rig two times a day, at 12 PM and 12 AM. The report would contain emergency useful information including name, company, length of stay, and the like. Information on when certificates expire may be used in scheduling how long personnel may stay and/or classes for upgrading the certificates. In some cases, personnel who are new to offshore operation can also be assigned persons to orient them to the offshore location, as may be protocol for some offshore locations. Personnel arrival/departure information and/or other data as discussed above is also forwarded to cloud database 34, which maintains all information created by person on board system 100 and allows authorized people off-site to monitor system 100.

In one embodiment, all certifications required to perform services offshore will be input into database 34 and linked to each individual identification card 8. Individual cards 8 may or may not also comprise this information in electronic form. Examples of certifications and licenses commonly required in the industry includes, but is not limited to, Transportation Worker Identification Card (TWIC card), Water Survival, Helicopter Underwater Egress Training (HUET), Basic Offshore Safety Induction and Emergency Training (BOSIET), CPR training, Fire Fighting, Well Control, driver's licenses, and passports. Accordingly, in this embodiment, system 100 will eliminate the need to present four to six individual cards and/or certifications to perform services offshore, as all cards and/or certifications will be linked to universal identification cards 8. Identification cards 8 can be recognized in any place person on board system 100 is installed, including heliports, platforms, rigs, marine vessels, and the like. Accordingly, instead of requiring each person to carry significant documentation, where different documentation is often needed at different offshore rigs, a universal identification card 8 can be utilized that allows the user to go to different rigs where person on board station 100 is installed. The system can be used to generate various reports regarding persons on board, e.g., names associated with the beds and the number of beds remaining. The reports can be generated twice a day or as desired.

Figure 3:
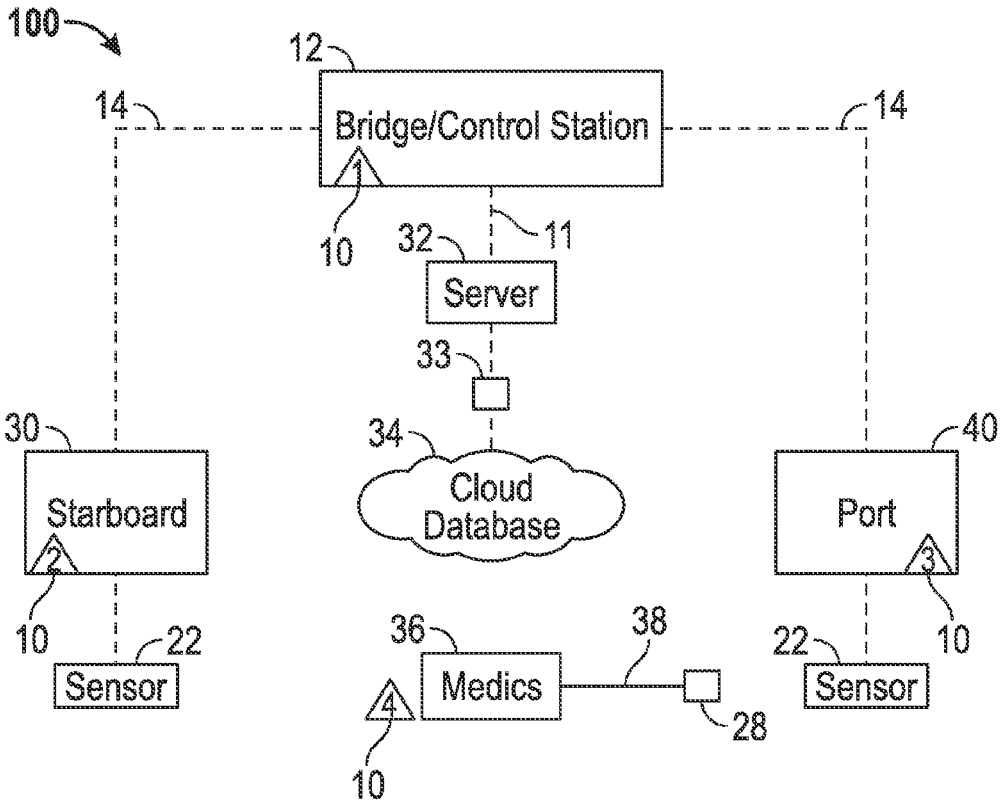
FIG. 3 is a diagram of a person on board system in accord with one possible embodiment of the present invention.

FIG. 3 is a diagram of person on board system 100 in accord with one possible embodiment of the present invention. In this embodiment, person on board system 100 controls the emergency protocols on the rig or platform. Control station 12 provides Ethernet connection 11 to server 32, which then transmits information to cloud database 34 via data line 33, which may comprise a radio transmitter, such as a microwave transmitter, or other suitable means such as underwater cables or the like. Muster apparatuses 10 are located at strategic points throughout the ship such as starboard station 30 and port station 40. Control station 12 and/or medic station 36 may or may not be utilized as muster stations. Each muster station can operate generally as described hereinbefore with regards to FIG. 1, serving as decentralized meeting points to administer the desired safety protocol during an emergency situation. Preferably fixed position starboard and port muster stations 30 and 40 are utilized for detecting the personnel during drills and emergencies. If it is necessary to abandon the rig, then sensor 22 can be utilized to determine that the lifeboats are launched, as discussed hereinbefore.

Variations of fixed muster stations 30 and 40 are possible using moveable detectors. For example, medic station 36 can be a portable configuration allowing a doctor or medic to move muster station 10 around the rig or platform, should there be people in need of attention whom cannot reach medic station 36. For example, the medic or other personnel could operate moveable detector 28 discussed hereinbefore. While port station 40 and starboard station 30 are connected with control station 12 by means of fiber optic cables 14, medic station 36 may be connected with control station 12 through either Ethernet or Wi-Fi signal 38.

Figure 4:
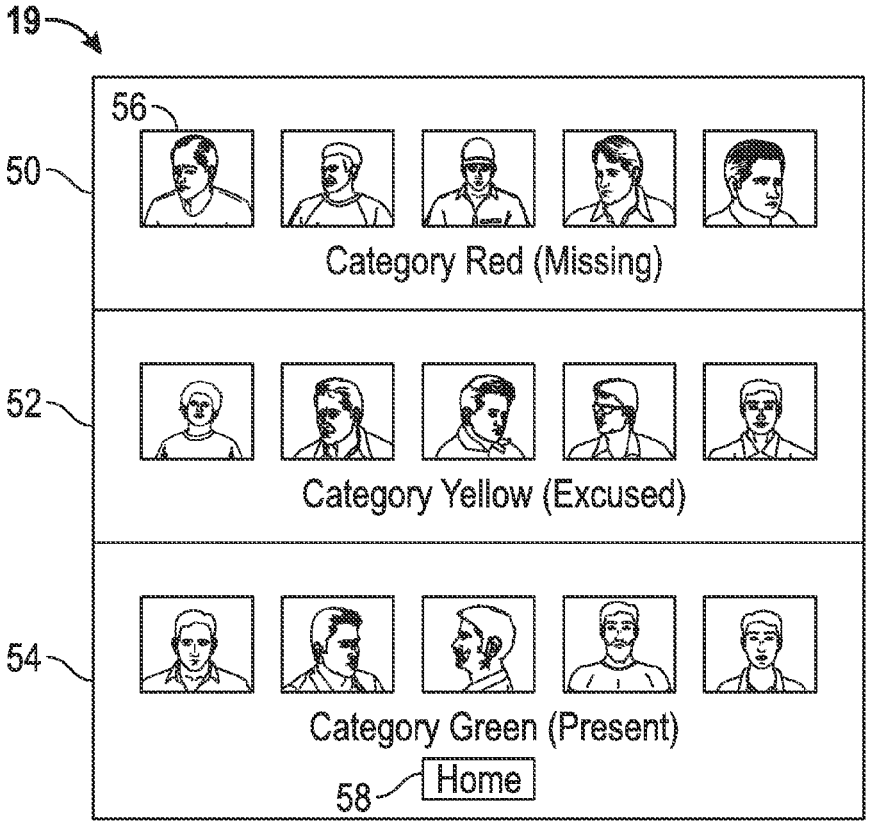
FIG. 4 is a diagram of a software program depicting personnel on board in accord with one embodiment of the present invention.

As discussed hereinabove, person on board system 100 can comprise two primary emergency protocols, a mustering protocol and an abandon protocol. When alarm is initiated for a mustering of platform or rig, a signal will be transmitted to each muster apparatus 10 comprising part of muster system 10 via signal wire 16. System 100 may then be turned on and begin to search for identification cards 8 within a readable range of detectors 20 of mustering apparatus 10 and pick up identification numbers associated with identification cards 8. System 100 will have link to cloud database 34 and display information of individual linked to the identification number. The information will be displayed to offshore personnel in graphical user interface (GUI) program 19 (see FIG. 2) in monitor and/or touch-screen 18 as depicted in FIG. 4.

GUI program 19 provides an intuitive easily operated program that can be utilized to provide up to date information regarding personnel during drills and emergencies. Accordingly, GUI program 19 is especially useful during emergencies where simple operation is desirable. Referring to FIG. 4, in one embodiment, GUI program 19 will allow the capability to monitor status of three different groups of personnel identified as "Present" 54, "Excused" 52, and "Missing" 50. Background colors may be used in each group such as red for "Missing", yellow for "Excused" and green for "Present." GUI program 19 will allow the capability to select an individual's picture 56 through the monitor and/or touch-screen 18, which can display profile picture, name, company, room number, individual notes, job location, and the like. Person on board system 100 will have the capability to excuse individuals who have been identified as a fire-fighting team and/or excused for a drill due to work, illness, and the like. In one embodiment, a listing all members in the database is utilized with references to the primary muster station, secondary muster station, lifeboat and the like so that each computer will have all relevant information and can sort the information as needed without the need for specific local registries for lifeboats, primary muster station for each person, and the like. Various types of spreadsheet programs or other database programs can be utilized for this purpose.

Figure 5:
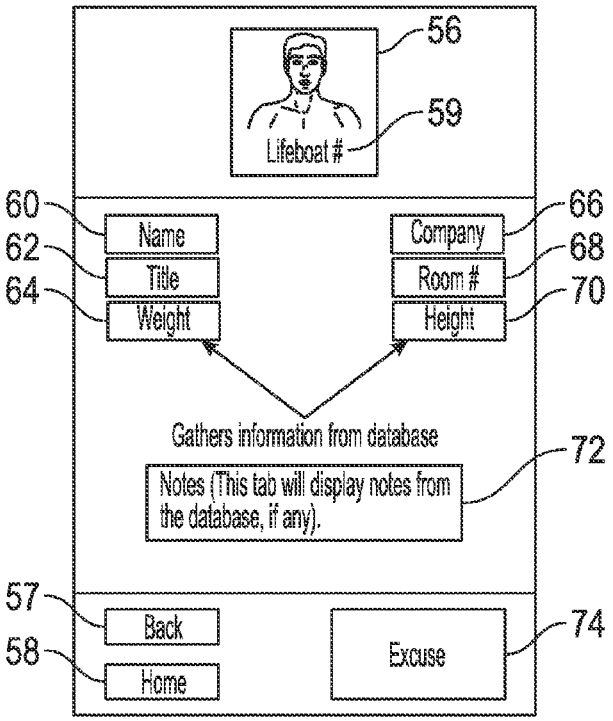
FIG. 5 is a diagram of a software program depicting information of personnel on board in accord with one embodiment of the present invention.

If a person is selected or touched, then as shown in FIG. 5, a diagram of output from software program 19 depicting information of personnel on board is depicted. After selecting individual's picture 56, a new screen appears displaying name 60, company 66, job title 62, room number 68, height 70, weight 64, and notes 72. All this information is gathered from cloud database 34 and/or local information storage, which may be regularly coordinated with each other when any changes are made. Additional information may comprise assigned primary and secondary muster stations and include lifeboat number 59 in the case of an abandonment scenario. Excuse button 74 will allow a user to input a passcode to excuse the individual and/or identify the individual as present. Back button 57 and home button 58 provide navigation options for a user to navigate GUI program 19. Accordingly, the information is conveniently laid out for use in an emergency.

GUI program 19 will link to database 34 and confirm all individuals are present who have not been excused from a drill and/or have option to abandon rig. After mustering is complete, system 100 will generate a report to cloud database 34 which can be accessible through a website or the like. The report can display name, time present, personnel missing, and the like as selected. System 100 will have the capability to send notification to onshore personnel via email, text, and the like, confirming a mustering scenario has occurred, status, drill metrics, and other information.

Figure 6:
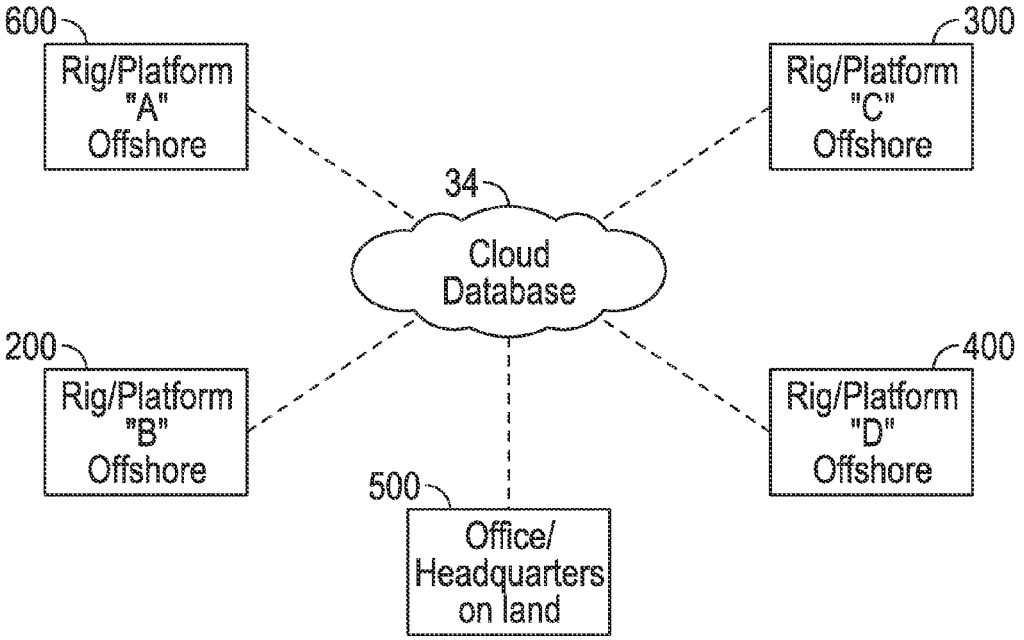
FIG. 6 is a diagram of a person on board system across multiple offshore locations in accord with one possible embodiment of the present invention.

FIG. 6 is a diagram of person on board system 100 across multiple sites in accord with one possible embodiment of the present invention. Person on board system 100 has been described in terms of a single rig hereinbefore, but system 100 may operate across multiple platforms within the present invention. Cloud database 34 serves as a hub for offshore rig or the like, "A" 600, Rig "B" 200, Rig "C" 300, and Rig "D" 400 to be seamlessly monitored from onshore headquarters 500 while keeping information in real time. Each rig or platform will contain a mustering system 100 configuration as described in connection with FIG. 3. Personnel cards 8 may be universally usable in any of the rigs for more consistent and reliable person on board system operation.

Accordingly, if an alarm is initiated for an abandoning a platform or rig, a signal will be inputted to system 100, such as by signal wire 16. The system detectors 20 will then begin to search for personnel cards 8 within a readable range and pick up the identification number associated with card 8. Personnel may pass by screen 19 and verify they have been detected by the system. As noted before, system 100 will have link to the database of personnel, such as cloud database 34 and/or a local database on server 32, if present, and display information of individual linked to the identification number. The information can be displayed to offshore personnel, e.g. at bridge control room 12, in a GUI program in monitor and/or touch-screen. Alternatively, the information can be displayed at onshore headquarters 500 or other desired location. If the abandonment process is initiated information about personnel at mustering stations and the lifeboats is available. In another embodiment, system 100 may also have the capability to have scanning a handheld device 28. During abandonment, system 100 will generate a report to cloud database 34 which can be accessible through a web-base. In one embodiment, report may display name, time present, personnel missing, lifeboat number, and the like. System 100 will have the capability to send notification to onshore personnel via email, text, or other means, confirming a drill, an emergency, and/or an abandon rig scenario has occurred and the personnel status.

The foregoing description of the preferred embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A person on board system for an offshore location, comprising:

a plurality of identification cards each comprising a machine detectable identifier;

a plurality of detectors operable for detecting said machine detectable identifier;

a cloud database for storing a plurality of user profiles associated with said plurality of identification cards;

a plurality of computers at said offshore location configured with a software program for interfacing with said cloud database and respective of said plurality of detectors;

a computer positioned away from said offshore location configured for accessing said cloud database;

at least one registration station at said offshore location comprising at least one of said plurality of computers operably connected with said cloud database and at least one of said plurality of detectors for scanning identification cards entering said offshore location and for populating said cloud database with on board personnel;

a first fixed mustering station positioned on a first side of said offshore location, said first fixed mustering station comprising at least one of said plurality of computers operably connected with said cloud database and at least one of said plurality of detectors for registering a location of said plurality of identification cards at said first mustering station;

a first moveable mustering station comprising a first lifeboat; and a first lifeboat sensor to detect movement of said first lifeboat.

2. The system of claim 1 wherein at least one said plurality of computers comprises a touchscreen, wherein said touchscreen displays pictures of said on board personnel who are missing, excused, and present at said fixed mustering station during at least one of a drill or emergency.

3. The system of claim 2, wherein touch selected of said pictures of said on board personnel on said touchscreen are responsive to access a respective of said plurality of user profiles.

4. The system of claim 1 further comprising a signal wire operable for signaling a drill, emergency or abandonment, and a separate data line for communicating between said plurality of computers and said cloud database.

5. The system of claim 1, further comprising a second fixed mustering station positioned on a second side of said offshore location, said second fixed mustering station comprising at least one of said plurality of computers and at least one of said plurality of detectors for registering said location of said plurality of identification cards within said second fixed mustering station;

a second moveable mustering station comprising a second lifeboat and a second lifeboat sensor to detect movement of said second lifeboat;

a control station operably connected to said first fixed mustering station, said first moveable mustering station, said second fixed mustering station, and said second moveable mustering station for receiving data comprising said location of said plurality of identification cards;

a server in communication with said cloud database and said control station; and a radio transmitter operable for communication with said cloud database.

6. The system of claim 1, further comprising at least one of said plurality of computers is operable for producing a daily list of said on board personnel and assigned beds and a list of beds available.

7. The system of claim 1, further comprising a moveable detector operable for locating identification cards of missing personnel in said offshore location.

8. The system of claim 1, wherein said plurality of identification cards each comprise an antenna and said plurality of detectors each comprise an antenna.

9. A method for a person on board system for offshore locations, comprising:

providing a plurality of identification cards each comprising a machine detectable identifier;

providing a plurality of detectors operable for detecting said machine detectable identifier at a plurality of said offshore locations;

providing a cloud database for storing a plurality of user profiles associated with said plurality of identification cards;

providing that said user profiles comprise a plurality of certifications for work offshore wherein at least one certification is required for entering a respective of said plurality of offshore locations;

providing a plurality of computers at said plurality of offshore locations configured with a software program for interfacing with said cloud database and said detectors;

providing at least one registration station at each of said plurality of offshore locations comprising at least one of said plurality of computers operably connected with said cloud database and at least one of said plurality of detectors for scanning identification cards entering said offshore location and for populating said cloud database with on board personnel for each of said offshore locations; and providing a first fixed mustering station positioned on each of said plurality of offshore locations, said first mustering station comprising at least one of said plurality of computers hosting said software program operably connected to at least one of said plurality of detectors for registering a location of said plurality of identification cards within a desired zone of said first mustering station.

10. The method of claim 9, comprising providing that at least one said plurality of computers comprises a touchscreen, wherein said touchscreen comprises pictures of said on board personnel who are missing, excused, and present at said fixed mustering station during at least one of a drill or emergency.

11. The method of claim 10, comprising providing that individual said pictures of said on board personnel on said touchscreen are responsive to touch to provide information about individual of said on board personnel.

12. The system of claim 9 further comprising providing a signal wire on each of said plurality of offshore locations operable for signaling a drill or an emergency or an abandonment, and providing a separate data line for communicating between said plurality of computers and said cloud database.

13. The method of claim 9 further comprising providing a first lifeboat in close proximity to said first fixed mustering station for said plurality of offshore locations, each said first lifeboat being equipped with a sensor emitting tracking location to said cloud database.

14. The method of claim 9, further comprising providing a first moveable mustering station comprising a first lifeboat, and providing a first lifeboat sensor to detect movement of said first lifeboat.

15. A method for a person on board system for offshore locations, comprising:

providing a plurality of identification cards each comprising a machine detectable identifier;

providing a plurality of detectors operable for detecting said machine detectable identifier at an offshore location;

providing a cloud database for storing a plurality of user profiles associated with said plurality of identification cards;

providing a plurality of computers at said plurality of offshore locations configured with a software program for interfacing with said cloud database and said detectors;

providing at least one registration station at each of said plurality of offshore locations comprising at least one of said plurality of computers operably connected with said cloud database and at least one of said plurality of detectors for scanning identification cards entering said offshore location and for populating said cloud database with on board personnel for each of said offshore locations;

providing a first fixed mustering station positioned on each of said plurality of offshore locations, said first mustering station comprising at least one of said plurality of computers hosting said software program and being operably connected to at least one of said plurality of detectors for registering a location of said plurality of identification cards within a desired zone of said first mustering station; and providing that at least one said plurality of computers comprises a touchscreen, wherein said touchscreen comprises pictures of said on board personnel who are missing, excused, and present at said fixed mustering station during at least one of a drill or emergency and that individual said pictures of said on board personnel on said touchscreen are responsive to touch to provide information about selected of said on board personnel.

16. The method of claim 15, comprising providing that said user profiles comprise certifications for work offshore required for entering respective of a plurality of offshore locations.

17. The system of claim 15, further comprising providing that said touch screen comprises a button utilized to excuse personnel from a drill.

18. The method of claim 9 further comprising providing a first lifeboat in close proximity to said first fixed mustering station for said plurality of offshore locations, said first lifeboat being equipped with a sensor emitting tracking location to said cloud database.

19. The method of claim 15, further comprising providing a first moveable mustering station comprising a first lifeboat, and providing a first lifeboat sensor to detect movement of said first lifeboat.

20. The method of claim 15, further comprising providing a moveable detector that is wirelessly connected to at least one of said plurality of computers.

* * * * *